United States Patent [19]

Hicks et al.

[11] 4,285,098

[45] Aug. 25, 1981

[54] DOOR HINGE HAVING TORSION BAR HOLD-OPEN STRUCTURE

[75] Inventors: Ralph R. Hicks, Grand Prairie; Guadalupe J. Martinez, Fort Worth, both of Tex.

[73] Assignee: Vought Corporation, Dallas, Tex.

[21] Appl. No.: 34,873

[22] Filed: Apr. 30, 1979

[51] Int. Cl.[3] ..... E05D 11/10

[52] U.S. Cl. ..... 16/145; 16/146

[58] Field of Search ..... 16/145, 146, 180

[56] References Cited

U.S. PATENT DOCUMENTS

| | | | |
|---|---|---|---|
| 3,370,317 | 2/1968 | Marchione | 16/145 |
| 3,388,420 | 6/1968 | Ballantyne | 16/180 X |
| 3,408,684 | 11/1968 | Marchione | 16/145 |
| 3,434,179 | 3/1969 | Marchione | 16/145 |
| 3,870,361 | 3/1975 | Krause | 16/145 X |
| 3,889,316 | 6/1975 | Kolke | 16/145 |
| 3,969,789 | 7/1976 | Wize | 16/145 |
| 4,129,922 | 12/1978 | Law et al. | 16/180 X |

*Primary Examiner*—Wm. Carter Reynolds
*Attorney, Agent, or Firm*—James M. Cate

[57] ABSTRACT

A door hinge and hold-open apparatus incorporates a torsion bar structure, having detent and torsional portions, carried by a first hinge member. A striker is carried by a second hinge member in alignment with the detent portion of the torsion bar structure for engaging the detent portion upon movement of the second hinge member, relative to the first hinge member, through a predetermined positional range. A torsional section of the torsion bar structure extends along an elongated body of one of the hinge members, and load carrying portions of the torsion bar structure which bear against the elongated hinge body are spaced from a mid-section of the hinge body at which the body is attached to a door or support structure. The apparatus is particularly adapted for use in a hinge having body portions of non-metallic, composite construction having reinforcing fibers extending longitudinally of the hinge body.

20 Claims, 8 Drawing Figures

DOOR HINGE HAVING TORSION BAR HOLD-OPEN STRUCTURE

This application relates to door hinge and hold-open structures and, more particularly, to such a structure incorporating a torsion bar spring hold-open structure.

A number of door hinge and hold-open devices have been developed or proposed, particularly with respect to hinges adapated for mounting doors on automobile bodies. Such hinges must sustain the loads received from doors of substantial weight and size, and the hold-open devices must be operable to provide reliable hold-open action, yet be sufficiently yieldable to permit closing and opening of the doors from various positions with an acceptable degree of manual force. Forces tending to move a door through a particular range are opposed by a hold-open structure incorporating a spring element normally carried by one hinge element, and at least one striker element mounted on the opposite hinge member for reacting against the spring member during movement of the door. Because of the very high spring forces which often are required, certain automotive hinges have made advantageous use of torsion bar spring structures. Such a spring structure may be mounted on one of the hinge members and have detent portion engageable with a striker mounted on the other hinge member in alignment with the detent portion. Torsion bar spring elements provide the high spring forces required, yet employ a relatively small spring element. Such hinge structures have produced the reliable hold-open action required in automotive applications and are adapted, by the use of multiple rollers or striker means, to maintain a door in both a fully open, and at least one partially open position.

Although such torsion bar spring structures are advantageous in regard to size and weight considerations, it will be understood by those in the art that extremely high forces are exerted by portions of the torsion bar structures secured or mounted in portions of the hinge bodies or other supporting structure. Such forces may include those employed to preload the torsion bar element, along with those additionally received during deflection of the bar as a striker is moved thereacross. As an example, in a typical hinge structure supporting a door approximately three feet in width between hinge axis and handle, loads in the order of 10,000 psi may be exerted by portions of such torsion bars against the mounting constraints when as little as 20 pounds of manual force is applied at the door handle during opening or closing of the door. In certain previous designs, such torsion bar structures have been of a plan form generally approximating a C or S configuration, wherein at least one of the linear sections or legs thus defined extends generally parallel to the hinge axis and laterally relative to a central region of one of the hinge bodies. Typically, an elongated torsional section extends laterally across a hinge member body and is seated within grooves or bores cut in the body for its support, with lever arms extending laterally from opposite ends of the torsional section in a direction generally parallel to the hinge body. Legs extending from the ends of these lever arms are then seated within appropriate grooves or mounting means in the hinge body for inducing a preload torsional stress in the torsional section, one of the legs having a detent portion which is engaged by a striker means mounted on the other hinge member during operation. Because the structure of the hinge body carrying the laterally extending torsional section is often notched, bored, or otherwise cut away to recieve the torsional section, the remainder of the hinge body is accordingly heavier than would otherwise be necessary to sustain the loads of the door itself, and to provide a margin of safety from forces which may be experienced in an accident, unless alternatively an additional mounting structure is welded or otherwise applied to the hinge body. In addition, the application of the great lateral stress loads exerted by the torsional bar section to a midportion of the door hinge may tend to induce stress failure in that portion of the hinge body. The midportion of an elongated door hinge member also sustains a concentration of loads in its function of supporting the door weight, and repeated stress loads produced by the momentum of the door when it is thrown open to its fully opened position against the door stop element of the hinge. As will be more fully understood from the description to follow, it is preferable, from a strength-of-materials standpoint, for the hinge member to sustain the lateral loads imposed by the torsional section at a distal end portion of the hinge member adjacent or beyond the bolts or other fastening means connecting the hinge member to the door or support structure to which it is attached.

Door hinges for automotive applications often include a hinge body having a "bolt-down" planar body area extending at least partially along the length of the hinge body outwardly from the hinge axis. A common and economical structural form for such an elongated hinge body is that known in the art as a channel section structure wherein a sheet of material is formed with upwardly extending flanges or the like on either side of a planar midportion, extending from the hinge axis. The planar, central portion is adapted to be bolted to the door or structural support member to which the hinge is mounted, and the outwardly projecting flanges serve as reinforcing members adding structural strength to the hinge body. Fasteners may be extended through several openings formed along the length of the planar midportion, but stress loads are concentrated around those fasteners or bolts positioned nearest the hinge axis. This is because these innermost fasteners relative to the axis sustain most of the weight of the door during static loads; because surface contact friction over the length of the body decreases the loads imparted to outer fastener elements; and because during application of dynamic loads resulting from the momentum of the door as it is flung open to its fully open position, the moment arm through which stress is applied to the innermost fasteners is shorter than the moment arm extending to the outermost fasteners. That is, when the door is flung open, the elongated hinge body (normally affixed to the vehicle body structure) sustains forces which tend to pry the hinge loose from the body structure and which, absent the bolts, would induce a rocking movement of the hinge member about a vertical fulcrum line extending across the portion of the hinge body contacting the support structure nearest to the hinge axis. The hinge body portion extending beyond this fulcrum line is thus urged away from the support structure and, absent the fasteners, would tend to rock outwardly about the fulcrum line. It will be understood then that the above-described rocking forces applied to the innermost fasteners, closest to the hinge axis, are substantially greater than those applied to the outer fasteners because of the smaller moment arms defined between the inner fasteners and the fulcrum line, and also because a degree of flexibility inherent in the metal hinge body, beyond the innermost fasteners, may minimize the loads reaching the outermost fasteners. In addition to the structural load concentrations discussed thus far, the absence of material at the bores or slots formed for receiving bolts or the like also tends to reduce structural strength at the fastener areas.

It will be apparent from the above discussion that it would be desirable to construct such a hinge body wherein the additional loads induced by the torsional member are not added to the other loads already concentrated around the midportion adjacent the inner fastener members and wherein the midportion is not weakened by notches or apertures for mounting the torsional member. As was suggested above, in existing hinges, loads sustained around the middle or inner areas of the hinge body are accommodated by merely ensuring that the size and construction of the adjacent structure are adequate to sustain the loads. When a torsional element is extended laterally across a hinge body and mounted in notches cut into reinforcing, side flanges, (or through a suitable aperture or the like formed through the flange) the material remaining below or adjacent the groove or aperture must be sufficient to sustain the loads. As will be understood by those in the art, this stress concentration thus induced under such a torsion element is concentrated in the cutout area, and the remaining portions of the flanges which are not cut away are thus of greater size and weight than would otherwise be necessary. Whereas such weight and material factors may not be critical considerations in applications wherein weight is not considered a high priority design factor, they become more significant, for example, when the overall weight of a vehicle is a critical factor in increasing gas mileage, in that prior-art hinge structures are necessarily of fairly massive and heavy construction because of the high loads sustained.

Particularly when it is desired to reduce weight by the use of composite, thermoplastic materials, such stress concentrations are a major consideration. The usual metal alloys may be considered substantially homogeneous and isotropic materials, and have good strength characteristics in relation to loads received from all directions. However, anisotropic materials such as thermoset polymers reinforced with continuous fibers exhibit substantially lesser resistance to loads applied in a direction normal to the axial orientation of the fibers. When such materials are used in the fabrication of channel members for use as hinge bodies as has been discussed, the fibers normally are extended along the length of the hinge bodies perpendicular to the hinge axes. Accordingly, when notches are cut into the flanges of such a nonmetallic hinge structure, and when stress forces perpendicular to the fibers are received in the notches as a result of loads imparted by the laterally extending torsional element of a conventional door check structure, unacceptable degrees of stress failure may result at these notched areas below the torsional element. Such composite hinge members may of course be reinforced and built up in the notched area to sustain the loads, but economic and weight factors argue against such localized reinforcing.

It is, accordingly, a major object of the present invention to provide a new and improved door hinge and check structure of the type employing a torsion bar spring element.

Another object is to provide such a hinge structure in which increased economy of size and weight is provided without deleterious effect upon the load sustaining characteristics of the hinge.

A further object is to provide a hinge structure which is particularly applicable to be constructed with lightweight anisotropic materials such as fiber/plastic composites.

Yet another object is to provide such a structure in which the torsional spring section is not required to be mounted in a position on a hinge member in which it extends laterally of the hinge body.

A still further object is to provide such a hinge structure in which the torsional section is extended along a plane generally perpendicular to the hinge axis.

Another object is to provide a door hinge and check structure having the above-stated advantages which nonetheless is of practicable and inexpensive manufacture.

Other objects and advantages will be apparent from the specifications and claims and from the accompanying drawing illustrative of the invention.

Figure 1:
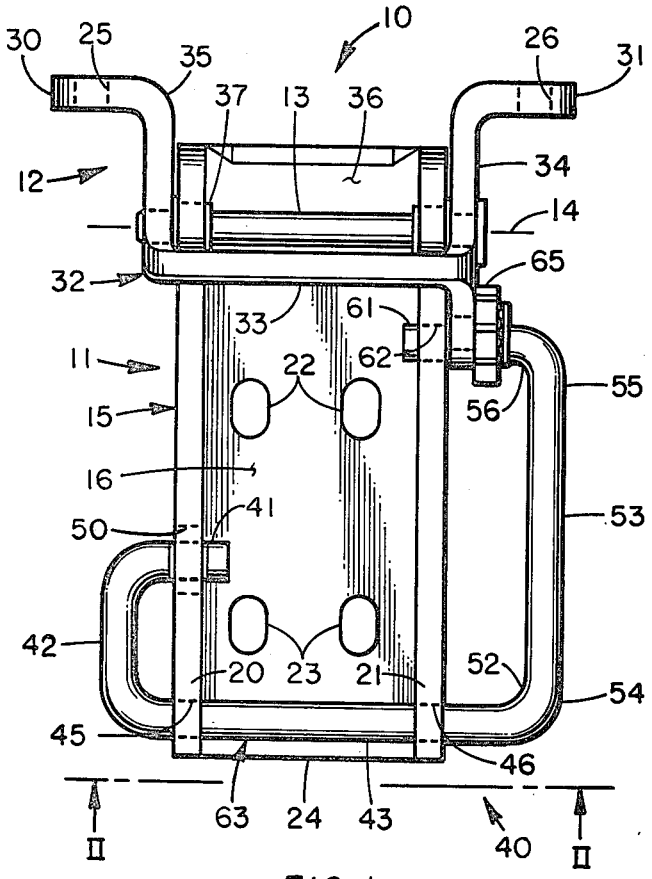
FIG. 1 is a plan, side view of a door hinge and check structure employing a first embodiment of the invention.
Figure 3:
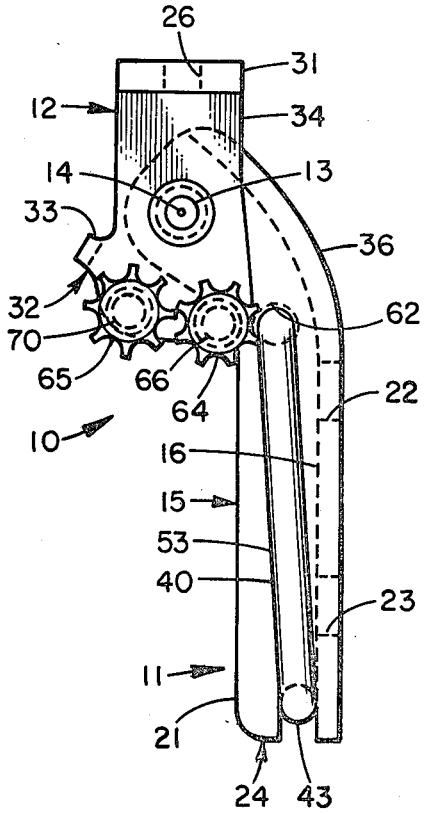
FIG. 3 is a top view of the structure of FIG. 1 showing the door hinge in a first, door-closed position.
Figure 2:
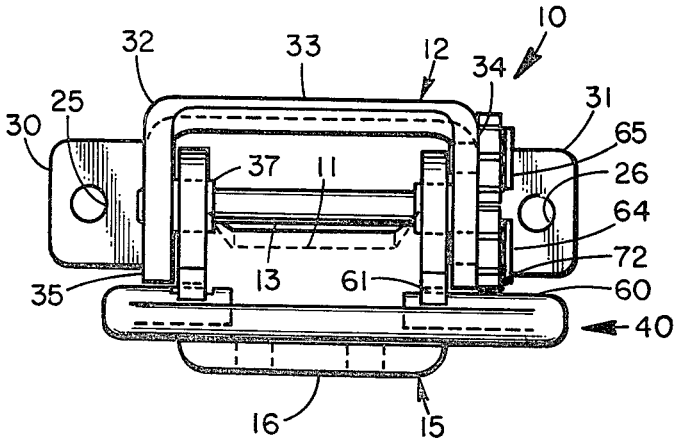
FIG. 2 is an end view taken as on line II—II of FIG. 1.
Figure 4:
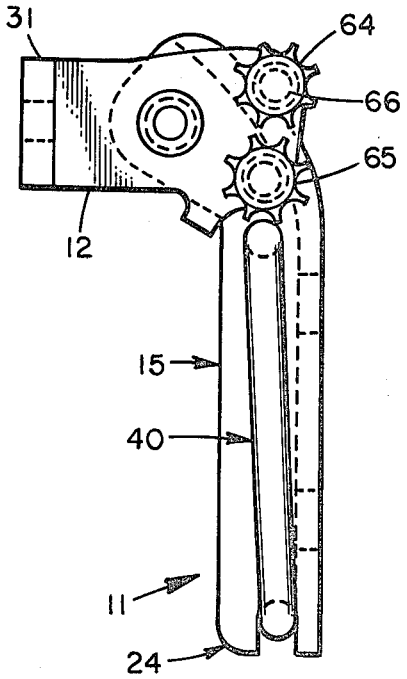
FIG. 4 is a top view, similar to FIG. 3, showing the door hinge in a second position corresponding to its configuration when supporting a door in a fully-open position.

With initial reference to FIGS. 1–5 and with primary reference to FIG. 1, a first and generally preferred embodiment of the door hinge and check structure 10 includes first and second hinge members 11 and 12 pivotally interconnected by a hinge pin 13, the hinge pin comprising a means for permitting mutual pivotal movement of the two hinge members 11 and 12 about a hinge axis indicated at 14. The first hinge member 11 includes an elongated body portion 15 extending generally perpendicularly of the hinge axis 14. As seen more clearly in FIG. 2, the elongated body portion 15 is of conventional channel or U-shape cross-section and has an elongated, planar midportion or base region 16 (FIG. 1) continuous with outwardly projecting side flanges 20, 21 which extend along the length of the body portion 15 on either side of the base portion 16. The particular configuration of the hinge members 11, 12 used for illustration in the present description is adapted for supporting a car door hinged to a support structure or pillar, not shown, of an automobile. In such an application, the first hinge member elongated body portion 15 is adapted to be extended horizontally against a supporting structure of an automobile and is adapted to be fastened to said structure by bolts, not shown, extended through first and second pairs of openings 22, 23 formed through the planar base portion 16 of the hinge member 11. The second pair of openings 23 is positioned adjacent a distal end portion 24 of the first hinge member body 15 and the first pair of openings 22 is positioned more nearly in a central region of the body portion 15. As viewed in the drawing, the hinge body 15, when installed, extends forwardly along a right door support of an automobile, the second flange 21 being then disposed vertically above the first flange 20, and the second hinge member 12 is adapted to be bolted to the leading edge of a door wherein the door may swing open about the hinge axis 14. When the door is in its fully open position, the second hinge member 12 is pivoted outwardly to a second position as shown in FIG. 1. The hinge axis 14 thus extends, in the above-described automotive installation, in a generally vertical direction, and the second hinge member 12 is adpated to be bolted to the leading edge of a car door through bores 25, 26 formed through vertically extending, lower and upper rear mounting flanges 30, 31.

The mounting flanges 30, 31 project outwardly from a U-shaped main body portion 32 of the second hinge member 12 which includes a cross-member 33 extending vertically between upper and lower plate members 34, 35. The hinge pin 13 extends through and is non-rotatably seated within corresponding bores formed through the upper and lower plate portions 34, 35. The cross member 33 serves as a stop member which strikes the outer edge surfaces of the flanges 21, 20 upon the second hinge member 12 being in its second position (FIG. 4) corresponding to a fully open position of the door. The elongated body portion 15 of the first hinge member 11 curves outwardly toward the hinge axis 14, and the flanges 20, 21 are continuous with widened body portions 36, as shown most clearly in FIG. 3, which projects outwardly in a direction away from the planar base portion 16 for positioning the hinge pin 13 and axis 14 at a desired orientation adjacent to the lateral center of mass of the car door. Bushings 37 are seated in the widened body portions for permitting freedom of pivotal movement of the body portions relative to the hinge pin 13.

The hinge and check structure 10 is particularly suited for applications in which the hinge members 11, 12 are of a nonmetallic material, e.g., for reduction of weight. Accordingly, in the preferred embodiment, the hinge members 11, 12 are formed of a thermoset plastic matrix in which reinforcing fibers are embedded. Such fibers may be of graphite, if a high-strength application is entailed, or they may be a continuous glass fiber of a material such as that known in the art as "E-Glass," which is a low alkali, lime-alumina borosilicate glass, when economic factors dictate a more moderate cost. Glass fibers having somewhat better strength characteristics may be of magnesia alumina silicate glass (commonly known in the art as "S-Glass") which may be suggested for use in applications in which it is required to obtain increased stress resistance at somewhat higher cost. Suitable thermoset matrix materials include many of the polymer resins such as the polyesters and vinyl esters, and for higher strength applications, the epoxies. Advantageous forming methods for production of such channel-shaped composite hinge members include the use of pre-impregnated fiber rolls which are stamped into shape before curing and then folded over a mold prior to heat curing on the mold. As is known in the art, such composite structures do not exhibit the multidirectional, high stress resistance of steel and other metals, but are instead anisotropic, non-homogeneous materials having load resistance properties which vary greatly according to the direction and location of the load and resultant stress. For example, in the most commonly envisioned usage the fibers extend longitudinally of the elongated body portion 15 and of the flanges 20, 21. The flanges 20, 21 are most susceptible to stress fractures when forces are applied perpendicularly to the fibers, e.g., against the outermost edge surfaces of the flanges and toward the planar body portion 16, and they are far more susceptible to fracture induced by such lateral forces than are metal structures of similar size and configuration. As will be more fully understood from the description hereinbelow, the load sustained in such a composite construction from the preload and applied forces of a torsion bar structure of the conventional type, in which the torsional section extends laterally across the midportion of the hinge body 15 and exerts severe loads against flange portions defining mounting grooves (and the weakening of the flanges caused by the mounting grooves), would be beyond levels acceptable for extended, trouble-free service as required, for example, in automotive applications. In the present invention, a torsion bar spring structure 40 employed for producing door hold-open forces is of a particular configuration and orientation well suited for such applications and, as will be more fully understood from the description to follow, is adapted substantially to reduce the concentration of stresses imparted to the midsection of the hinge body 15.

Figure 5:
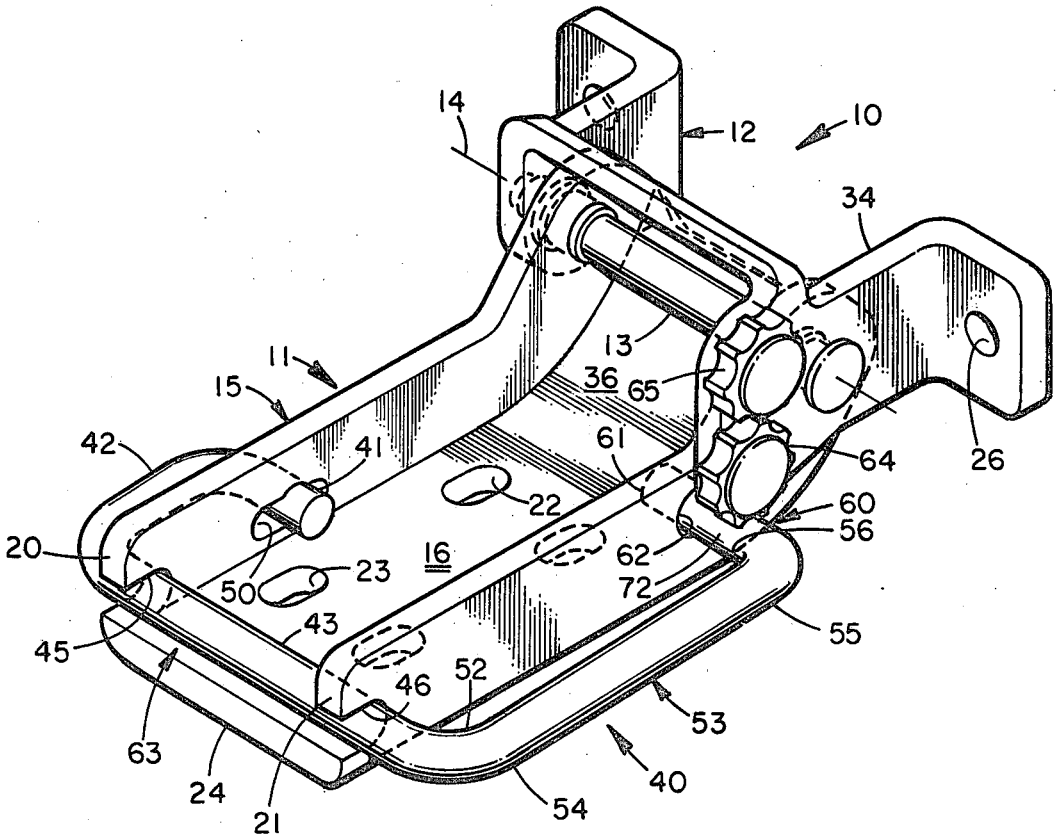
FIG. 5 is a perspective view of the door hinge and check structure of FIGS. 1–4.

With primary reference now to FIG. 5, the torsion bar structure 40 is preferably formed of a bar of spring steel which is heat formed to the required configuration and is substantially free of surface machining and stress marks. In the present embodiment, the torsion bar structure 40 comprises a continuous metal bar in which four 90° bends have been formed to define five generally linear sections, the sections lying generally in a planar region. The torsion bar structure 40 thus includes first, second, and third linear portions 41, 42, 43 extending approximately perpendicularly of each other to form a generally U-shaped anchoring portion. The third linear portion 43 extends across the distal end portion 24 of the elongated hinge body 15 and is seated within corresponding restraining grooves 45, 46 cut into the first and second flanges 20, 21. The distal end region of the first linear portion 41 projects within a corresponding slot 50 formed through the first flange 20 at a portion thereof spaced along the hinge body 15 from the hinge body distal end portion 24 toward the hinge axis 14. The restraining grooves 45, 46 are cut inwardly of the distal ends of the flanges 20, 21, respectively, and thus open outwardly in a direction opposite the second hinge portion 12. The third linear bar portion 43 extends, from the second linear portion 42, beyond the second flange 21, and at its opposite end it is sequentially continuous with a third 90° curved portion 52 and with an elongated, generally linear, torsional portion or section 53 which extends along the length of the hinge body portion 15 toward the second hinge portion 12. For ease of later reference, the end portion of the linear torsional section 53, contiguous and continuous with the curved section 52, is termed hereinafter the first end portion 54 of the torsional section 53, the opposite end portion being termed the second end portion 55. The second end portion 55 of the torsional section 53 is continuous with a fourth curved portion 56 itself continuous with a fifth linear bar portion which extends laterally with respect to the elongated torsional section 53. The fifth linear bar portion extends toward a portion of the first hinge member 11 spaced along the hinge body 15 from the body distal end portion 24 and from the first, second, and third linear bar portions 41, 42, and 43. As will be more fully understood from the description to follow, the fifth linear portion and the curved portion 56 serve as a lever to impart torsional forces to the torsional section 53, and they are thus termed hereinafter the lever arm 60. The lever arm 60 has a distal end portion 61 which projects through a corresponding opening 62 formed within the flange 21.

The portions of the torsion bar structure 40 which extend from the first end portion 54 of the torsional section 53, including the linear portions 41, 42 and 43, the interconnecting curved regions, and the supporting structure in the first hinge member body 15 for restraining the portions relative to the first hinge member 11, (i.e., the structure defining the hinge flanges 20, 21, the slot 50, and the constraining grooves 45, 46), together comprise a means for anchoring the first end portion 54 of the torsional section 53 to the first hinge member 11 for preventing any substantial axial rotation of the torsional section 53 at its first end portion 54. For convenience, the above-listed anchoring elements will be referred to hereinafter as the anchoring means 63. In addition to preventing axial rotation of the torsional section 53, the anchoring means 63 is preferably configured to impart a predetermined preload upon the torsional section 53 in a direction tending to urge the lever arm laterally toward the planar base portion 16, i.e., downwardly as viewed in FIG. 5. With added reference to FIG. 3, first and second peripherally fluted rollers 64, 65 are rotatably mounted upon the upper plate portion 34 of the second hinge member 12 by means of suitable pintles 66, 70 (FIG. 3), the rollers 64, 65 being laterally aligned with a portion 72 of the lever arm 60 between the lever arm distal end portion 61 and the second end portion 55 of the torsional section 53. The rotational axes of the rollers 64, 65 are spaced radially from the hinge axis 14 by a distance at which peripheral portions of the rollers are brought into contact with and urged against the lever arm 60 upon the second hinge member 12 being rotated about the hinge axis 14 from either its first or second position. The location on the lever arm 60 at which the rollers 64, 65 contact the lever arm is herein designated the detent portion 72 in that, as will be seen from the description hereinbelow, the detent portion 72 is engaged and deflected by the rollers 64, 65 as the second hinge member 12 is passed from its first to its second positional extremes, or in the opposite direction.

Figure 6:
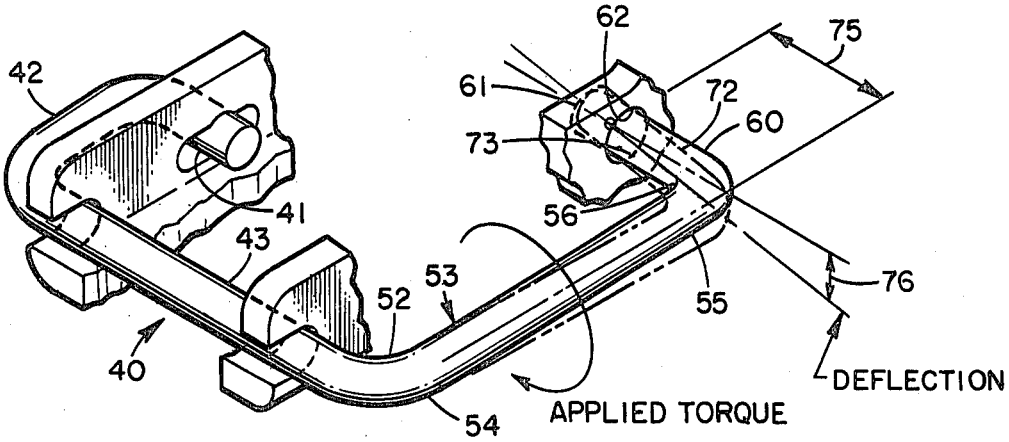
FIG. 6 is a fragmentary view similar to FIG. 5 showing the torsion bar structure with major portions of the hinge members cut away for clarity.

In prior-art devices, such as those disclosed in U.S. Pat. Nos. 3,550,185; 3,969,789; and 3,889,316, an arm serving as a detent portion of a torsion bar structure extends within a slot or enlarged aperture in a sidewall of an adjacent hinge member wherein the detent portion is free to move laterally within the slot, laterally of the hinge body, when so urged by a striker means. In such structures, an elongated bar section connected to the detent portion and extending along the hinge body serves as a lever arm (rather than a torsional section as in the present structure) to impart torsional stress to a linear, torsional section mounted on and extending laterally across the adjacent hinge body. The torsional section normally extends perpendicularly across a mid-portion of the hinge body in a direction substantially parallel to the hinge axis. In contrast, in the present structure the opening 62 is preferably not of an enlarged or widened configuration which will permit freedom of lateral movement of the distal end portion 61 within the opening 62 when the detent portion 72 of the lever arm 60 is depressed by the rollers 64, 65. Instead, the opening 62 preferably is only of sufficient size to permit limited rocking or pivotal motion of the lever arm 60 about a fulcrum 73 (FIG. 6) defined by the portion of the wall of the opening 62 lying between the lever arm 60 and the planar body portion 16, i.e. against which the lever arm 60 rests upon being depressed by striker means 64 or 65. The portion of the flange structure defining the opening 62 thus comprises a means receiving the distal end portion 61 of the lever arm 60 and caging the end portion 61 for preventing substantial lateral displacement of the distal end portions and for preventing lateral movement of the distal end portion beyond predetermined limits relative to the hinge body 15, and further comprises means providing a fulcrum 73 about which the lever arm 60 may rock or pivot. The opening 62 is preferably not so large as to permit excessive slop or lateral displacement of the lever arm 60 other than, as suggested above, that entailed to permit a desired degree of pivotal movement of the arm about the fulcrum 73, in response to movement across the arm thereacross by the rollers 64, 65.

In operation, as the second hinge member 12 is pivoted from its first to its second positions (FIGS. 1 and 4 respectively), the rollers 64, 65 are brought into contact with the lever arm 60, urging it inwardly or in a direction toward the planar region defined by the planar base portion 16. Because of the limited lateral movement of the lever arm distal end portion 61 in the opening 62, the lever arm 60 is thereby caused to rotate about the fulcrum point 73, arcuately displacing the second end portion 55 of the torsional section 53 inwardly (downwardly as viewed in FIG. 5) in a direction toward the plane defined by the outer surface of the planar body portion 16. With additional reference to FIG. 6, the lever arm 60 is caused to rotate about the fulcrum point 73 through an arcuate path indicated at 76, and torque is thereby applied to the torsional section 53 through the lever arm. The length of the lever arm is represented at 75 and, extends between the fulcrum 73 and the central, longitudinal axis of the torsional section 53. Because the first end portion 54 of the torsional section 53 is restrained from axial rotation by the anchoring means 63, the inward deflection of the lever arm 60 by the striker means 64, 65 (FIG. 5) induces an increased torsional stress over the length of the torsional section 53.

As the second hinge member is pivoted from its first to its second position (FIGS. 1 and 4, respectively), the roller 64 is brought into contact with the lever arm 60 at a predetermined pivotal position of the second hinge member relative to the first hinge member. As the second hinge member is then moved beyond the position at which contact is made, its arcuate path causes it to react with the detent portion 72, rocking the lever arm 60 inwardly to a maximum degree of deflection, as indicated by the arc represented by line 76 of FIG. 6. During this contact the stress induced in the torsion bar structure 40 exerts a force against the roller 64 opposing further movement of the second hinge member 12. The lever arm detent portion 72 is deflected by the respective rollers 64, 65 by the maximum angular deflection 76 upon either of the respective rollers being aligned between the lever arm detent portion and the hinge axis; that is, aligned with the roller axis lying along a plane coincident with the hinge axis 14 and bisecting the lever arm 60. As will be understood by those in the art, resistance to movement of the second hinge member 11 and, to a door attached thereto, will be greatest as the lever arm is being urged by one of the rollers toward one of the two positions of maximum deflection at which one of the rollers is thus aligned. The rollers 64, 65 thus comprise striker means imparting pivotal movement to the lever arm about the fulcrum 73 in a direction opposed by the preload torsional force on the torsional section 53. Upon contact, the lever arm detent portion 72 is engaged by one of the peripheral flutes of the rollers 64 and thereby tends to engage and induce rotation of the roller. If the pivotal movement of the second hinge member is then continued until the first roller 64 passes the lever arm 60, the lever arm 60 returns to its non-deflected orientation and is positioned between the rollers 64, 65, at which position the second hinge member 12 is in a midrange in which it tends to remain unless the second hinge member 12 is urged in either direction with a force sufficient to cause one of the rollers to pass over the lever arm. If moved to its second position (FIG. 4) corresponding to a fully open position of the door, the door is maintained in an open positional range until the door and second hinge member 12 are urged in an opposite direction with sufficient force to again pass the second roller, over the detent portion of the lever arm 53. Deflection of the lever arm by the rollers 64, 65 necessitates overcoming the preload spring torsion as well as the reactive torsional force received from the torsional section 53 as a result of the additional torsional stress imparted to the torsional section upon depression of the lever arm detent portion 72 by the rollers.

As will be understood by those in the art, the degree of resistance to pivotal movement of the hinge member 12 may be varied according to the requirements of a particular application by varying the diameter, length, and/or material properties of the torsional section 53. Reactive characteristics may also be varied by varying the position of the opening 62 or by varying the length of the lever arm 75 and/or the outward spacing of the rollers 64, 65 from the flange 21 or their radial spacing from the hinge axis 14. Such adjustments are not described in detail herein in that the mounting of dual rollers or other striker means at particular orientations for defining various door stop positions is generally known in the art with respect to conventional door stop spring hold-open structures. The present door hinge and check structure 10 is not limited to a particular configuration of such rollers, but may be used with other single arrangement of or plural striker elements, such as a cam structure of a selected coutour. It now will be seen that the preload force urging the lever arm 60 toward the rollers is added to the reactive force received upon depression of the detent portion by the rollers. In addition, it serves to retain the torsion bar structure in place, the distal end of the first linear rod portion 41 suitably having a notch or cutout portion adapted to engage the flange 20 for further preventing excessive lateral movement of the torsion bar structure 40 relative to the hinge body 15 which would change the lever arm distance between the fulcrum 73 and the detent portion 72. In other applications in which a spring preload is not desired, the torsion bar structure 40 is secured in place by the use of suitable locked bolts, cotter pins, clamping brackets, or other fastener means, not shown.

Whereas the spring torsion bar has been described as being of a particular form, it may also be made in other configurations within the scope of the appended claims. Essential to the invention, however, is the fact that the section (53) which sustains the greatest degree of torsional flexing does not extend generally parallel to the hinge axis 14, as in prior devices. In the preferred embodiment, the longitudinal axis of the torsional section 53 lies in a plane which is substantially perpendicular to the hinge axis 14. Again referring to alternative embodiments of the invention, the anchoring means 63 alternatively may comprise a flattened portion, not shown, of the bar structure 40 adjacent the first end portion 54 of the torsional section 53 which flattened portion is bolted or otherwise restrained from rotation, rather than the U-shaped, three-segment 41, 42, 43) portion of the anchoring means 63 as illustrated in FIGS. 1–5.

Figure 7:
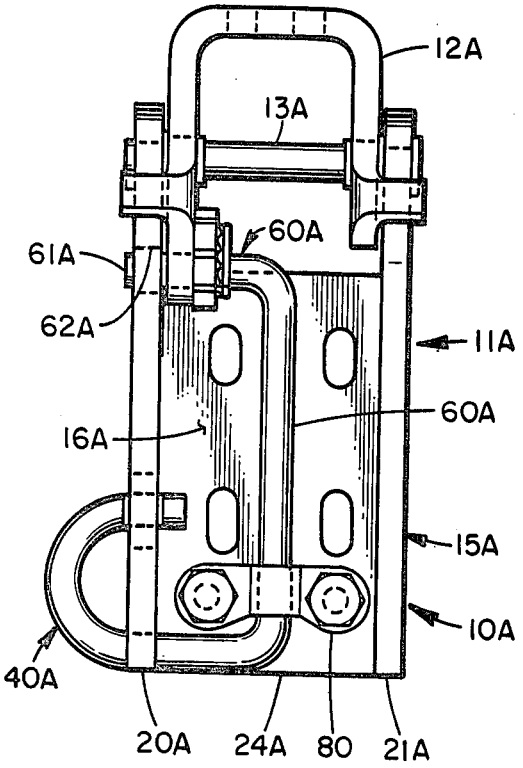
FIG. 7 is a plan view, similar to FIG. 1, of a door hinge and check structure constructed according to a second embodiment of the invention.
Figure 8:
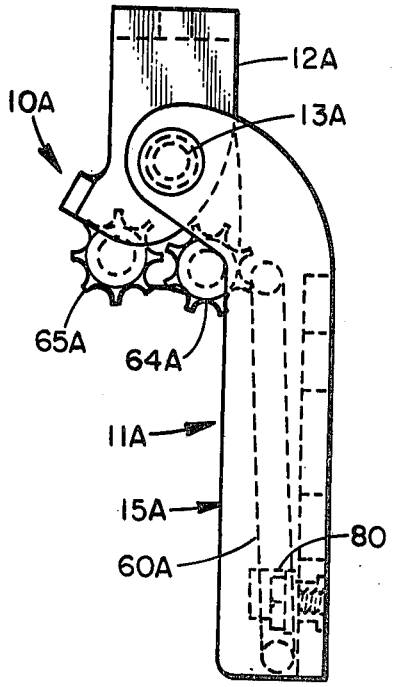
FIG. 8 is a top view of the structure of FIG. 7.

Another embodiment which is illustrated in the drawing in FIGS. 7 and 8 employs a torsion bar structure 40A having a torsional section 60A extending longitudinally of the first hinge member body portion 15A between first and second hinge member flange portions 20A, 21A. A mounting bracket 80 is bolted to the planar body portion 16A at a point spaced along the hinge body from its distal end portion 24A and is fastened over the torsional section 53A, at a location spaced from the lever arm 60A whereby the terminal section 53A is restrained from lateral movement and supported over the planar body portion 16A. The lever arm 60A is constrained within an opening 62A in the flange 20A of the first hinge member 11A, and the lever arm 60A is positioned sufficiently outwardly from the planar body portion 16A to permit a desired deflection of the lever arm toward the body portion 16A by the rollers 65A, 64A. The lever arm 60A is depressed about a fulcrum point defined by the opening 62A in essentially the same manner as has been described with reference to the first embodiment of FIGS. 1–6. Positioning of the mounting bracket 80 over the torsional section 60A at a location adjacent the distal portion 24A and spaced substantially from the lever arm 60A permits efficient use of most of the length of the torsional spring element 60A. It is highly preferred that the lever arm 60A in such an application be raised above the planar region 16A by the opening 62A and not be restricted or hindered in its rocking movement by connecting clips, mounting supports, or the like contacting the lever arm 60A, which may hinder or distort the freedom of torsional spring action.

In other applications, the torsion bar structure 40 may be mounted on the second hinge member; i.e., on the member to be mounted on a supporting structure.

In assembling, the hinge 10 and torsion bar structure 40 (FIGS. 1–6) the torsion bar structure 40 is conveniently mounted on the hinge body 15 by first inserting the third linear section 43 within the grooves 45, 46 with the first linear section 41 positioned to the external side of the first flange 20. The third linear portion 43 is fitted within the restraining grooves 45, 46. The torsion bar structure 40 then is urged laterally until the first linear portion 41 is engaged within the slot 50, and until the lever arm 60 is positioned to the side of flange 21, near or in approximate alignment with the planar body portion 16. The distal end portion 61 of the lever arm 60 is then urged outwardly unitl it is in alignment with the opening 62, this alignment requiring the imparting of a degree of preload stress, as has been previously described. The torsion bar structure is then moved laterally of the hinge body 15 in a direction bringing the lever arm distal end portion toward and within the opening 62, and until the groove 77 formed in the first linear portion 41 is brought into locking alignment with the flange 20.

It now can be understood that the door hinge and check structure 10 provides torsional spring restraining forces for positioning a door while at the same time minimizing the stress-induced problems commonly encountered with such torsion bar spring structures, which were outlined in the earlier sections relating to existing devices. With primary reference to the embodiment of FIGS. 1 through 6, the loads imparted to the hinge body 15 during movement of the rollers 64, 65 across the lever arm 60 are sustained at the fulcrum point 73, the structure of flange 21 defining the mounting groove or cutout 46 in the flange 21, and to a lesser degree, at the cutout groove 45 in flange 20. The greatest loads are sustained at the fulcrum point 73. Flange 20 sustains a lesser load stress because of the greater lever arm length between the flanges 20, 21 relative to the lever arm spacing between the fulcrum 73 and the rollers 64, 65. A relatively minor load is sustained in the region of slot 50. This is because the existence of fulcrum point 73, aginst which the lever arm distal end portion rides, minimizes any forces tending to rotate the torsion bar structure 40 about the axis of its laterally extending, third linear portion 43 as occurs in prior-art structures. As may easily be seen in FIG. 1, the door hinge and check structure 10 does not include a torsional section or other load imparting member extending across the mid-region of the hinge body portion 15, in the region of high stress concentration adjacent the fastener openings 22 nearest the hinge axis 14. In fact, the load bearing regions are spaced beyond even the second pair of openings 23 on the distal end portion 24, and well beyond the first pair of openings 22, in the opposite direction. Thus, the stresses applied to the first door hinge member 11 are distributed more evenly throughout the hinge body 15, and stress concentration adjacent the fist bolt openings 22 is substantially reduced. When used with a hinge body 15 of non-metallic, composite construction having its reinforcing fibers extending longitudinally of the hinge body 15, lateral forces perpendicular of the fibers in the hinge body flanges 20, 21 adjacent the bolt openings 22 are similarly greatly reduced, ensuring extended structural life of the material. Of even greater importance, the elimination of the slots previously employed to mount such a laterally extending torsion member eliminates the undesirable stress concentration and weakening effects of such slots on the flanges or other structural elements extending along the length of the hinge body. When used with conventional, isotropic, homogeneous materials such as steel, the elimination of a load bearing point in a central region of the hinge body and the elimination of the cutout areas in the cental region of the flanges 20, 21 (or other structural forms for supporting the laterally extending torsional section) reduces the material volume and the size of the components otherwise required to sustain such loads at the midsection and adjacent the first orifices 22. A savings of material as well as a reduction in weight and size is thus permitted. That is, the need for flanges or structural members of sufficient thickness or height to compensate for the weakening of the flanges produced by cutout mounting grooves adjacent the first bore openings 22, or their equivalent, is eliminated. Finally, it will be understood by those in the art that the invention is well adapted for practicable and inexpensive manufacture, and it may employ commonly available U-section stock.

While only two embodiments, together with modifications thereof, of the invention have been described in detail herein and shown in the accompanying drawing, it will be evident that various further modifications are possible in the arrangement and construction of its components without departing from the scope of the invention.

What is claimed is:

1. A door hinge and check structure, comprising:

first and second hinge members;

means interconnecting the members for permitting mutual pivotal movement of the members about a hinge axis, the first hinge member being adapted to be secured to a supporting structure, the second hinge member being adapted to be secured to a door which is swingable about the hinge axis relative to the supporting structure;

a torsion bar structure including an elongated torsional section having first and second end portions;

means anchoring the first end portion of the torsional section to the first hinge member at a portion of the first hinge member spaced from the hinge axis;

the torsion bar structure further comprising a lever arm extending from the second end portion of the torsional section and laterally of the torsional section toward a portion of the first hinge member spaced along the first hinge member from the anchoring means in a direction toward the hinge axis, the lever arm having a distal end portion and having a detent portion spaced between the lever arm distal end portion and the second end portion of the torsional section;

the first hinge member further having means for receiving said lever arm distal end portion, for preventing substantial lateral displacement of the distal end portion of the lever arm and constraining the lever arm against lateral displacement at its distal end portion beyond a predetermined position relative to the first hinge member, and for permitting pivotal movement of the lever arm about its distal end portion in a direction in which torsional stress is imparted to the torsional section;

striker means carried by the second hinge member in alignment with the detent portion of the lever arm and at a radial distance from the hinge axis at which the striker means is in engagement with said detent portion upon the second hinge member being pivoted upon the hinge axis through a predetermined positional range relative to the first hinge member.

2. A door hinge and check structure, adapted for mounting a door onto a vehicle body, comprising:

first and second hinge members and means, interconnecting the members, for permitting pivotal movement of the second hinge member relative to the first hinge member, about a hinge axis, between a first position corresponding to a closed position of the door relative to the vehicle body and a second position corresponding to a fully open position of the door, the first hinge member having an elongated body extending from the hinge axis, the body having a distal end portion spaced from the hinge axis;

a torsion bar structure carried by the first hinge member, the torsion bar structure comprising an elongated, axially extending torsional section having first and second end portions;

means anchoring the first end portion of the torsional section to the distal end portion of said elongated body portion, the torsion bar structure further comprising a lever arm continuous with the second end portion of the torsional section and extending laterally of the torsional section toward a portion of the first hinge member spaced along the first hinge member body from the body distal end portion, the lever arm having a distal end portion and a detent portion spaced between the distal end portion and the torsional section;

receiving means, in said first hinge member, for receiving the distal end portion of the lever arm, for preventing substantial lateral displacement of the distal end portion of the lever arm relative to said hinge body, the receiving means further comprising means providing a fulcrum and permitting pivotal movement of the lever arm, about its distal end portion, upon the fulcrum;

the anchoring means further comprising means imparting a torsional preload stress to the torsional section urging the lever arm distal end portion and detent portion in a first rotational direction about the torsional section axis and against the fulcrum; and striker means carried by the second hinge member in alignment with the detent portion of the lever arm and at a radial distance from the hinge axis at which the striker means is urged against the lever arm detent portion upon the second hinge member being pivoted about the hinge axis from either of its first and second positions.

3. The apparatus of claim 2, the striker means comprising at least one roller means mounted on the second hinge member for rotation about a respective axis substantially parallel to the lever arm and spaced radially from the hinge axis.

4. The apparatus of claim 2, the striker means comprising means imparting forces urging pivotal movement of the lever arm about the fulcrum, upon the striker means being urged against the lever arm detent portion, in a direction opposed by the torsional preload stress.

5. The apparatus of claim 2, the torsional section extending along the first hinge member body from the body distal end portion.

6. The apparatus of claim 2, the torsional section extending along an axis substantially deviating from the hinge axis.

7. The apparatus of claim 2, the torsional section extending along an axis coincident with a plane which is substantially perpendicular to the hinge axis.

8. The apparatus of claim 2, the torsion bar structure comprising a metal bar structure, the lever arm and the anchoring means at least partially comprising respective arms of the bar structure extending perpendicularly of the torsional section in a direction generally parallel to the hinge axis.

9. The apparatus of claim 2, the torsional section extending alongside the first hinge member body, the anchoring means including a portion of the torsion bar structure extending from the torsional section toward the distal end portion of the first hinge body.

10. The apparatus of claim 2, the torsional section extending alongside the first hinge member body, the anchoring means including a generally U-shaped portion of the torsion bar structure extending from the torsional section, one arm of the U-shaped portion extending through the distal end portion of the first hinge member body, the other arm extending in an opposite direction toward and within said body at a portion thereof spaced along the body from the body distal portion.

11. A door hinge and check structure of the type having a torsion bar structure for opposing relative movement of the hinge members, the door hinge and check structure comprising:

a first hinge member having an elongated body portion;

a second hinge member pivotally connected to the first hinge member for pivotal movement about a hinge axis;

a torsion bar structure carried by the first hinge member and having an elongated torsional section extending along the elongated hinge body portion and having a lever arm portion extending laterally from the torsional section;

means for preventing substantial lateral displacement of the lever arm relative to the first hinge member; and striker means, carried by the second hinge member, for deflecting the lever arm upon the second hinge member being pivoted through a predetermined positional range relative to the first hinge member.

12. The apparatus of claim 11, the torsional section having a longitudinal axis deviating from the hinge axis.

13. The apparatus of claim 11, the torsional section extending along an axis coincident with a plane which is substantially perpendicular to the hinge axis.

14. The apparatus of claim 11, the torsional section extending alongside the elongated hinge body portion.

15. The apparatus of claim 11, the elongated hinge body portion being formed of a fiber reinforced plastic material having fibers extending predominantly along the length of the body portion.

16. A door hinge and check structure comprising:

a first hinge member;

a second hinge member;

means for connecting one of the hinge members to a support structure and means for connecting the other hinge members to a door;

means pivotally interconnecting the first and second hinge members for permitting relative pivotal movement of the hinge members about a hinge axis;

a torsion bar structure carried by the first hinge member and having an elongated torsional section having first and second end portions and a lever arm extending from the first end portion and laterally on the torsional section, the lever arm having a distal end portion and a detent portion spaced between the lever arm end portion and the torsional section;

the first hinge member having an elongated body having an end portion adjacent the hinge axis and another distal end portion;

means anchoring the torsional section to the first hinge member distal end portion;

means for preventing substantial lateral displacement of the distal end portion of the lever arm relative to the first hinge member elongated body; and striker means for deflecting the detent portion of the lever arm during relative pivotal movement of the hinge members, and for imparting torsional stress to the torsional section.

17. The apparatus of claim 16, the anchoring means imparting a torsional preload stress to the torsional section, the striker means comprising means imparting forces causing pivotal movement of the lever arm about the fulcrum, upon being urged against the lever arm detent portion, in a direction in which said forces are additional to the torsional preload stress.

18. The apparatus of claim 16, the torsion bar structure, in combination with the striker means, comprising means for opposing relative pivotal movement of the second hinge member through at least one intermediate positional range with a limited degree of resistive force.

19. A door hinge and check structure of a type having two hinge members pivotally connected and a torsion bar structure carried by one of the hinge members for reacting with a striker means on the other of said hinge members and for opposing relative pivotal movement of the hinge members, the door hinge and check structure comprising:

a first hinge member having an elongated body of channel cross-sectional configuration having first and second flange portions projecting from a mid-portion extending between the flanges, the body having a distal end portion spaced from the hinge axis and at least one opening formed through one of the flanges at a location spaced from the distal end portion;

a second hinge member pivotally connected to the first hinge member;

a torsion bar structure carried by the first hinge member and having an elongated torsional section having first and second end portions and a lever arm extending laterally from the second end portion, the lever arm having a distal end portion;

means anchoring the first end portion of the torsion bar structure to the first hinge member body adjacent the hinge body distal end, the torsional section extending from the hinge body distal end along the elongated body of the first hinge member;

the lever arm extending toward and within the opening, the opening comprising means permitting pivotal movement of the lever arm;

means preventing substantial lateral displacement of the lever arm relative to the elongated hinge body of the first hinge member; and striker means, carried by the second hinge member, for depressing the lever arm at a location spaced between the lever arm distal end portion and the torsional section and for inducing pivotal movement of the lever arm within the opening about an axis substantially parallel to the torsional section.

20. The structure of claim 19, the first hinge member body portion being formed of a thermoset plastic matrix reinforced with fibers extending along the length of the body portion.

* * * * *